US009202419B2

(12) United States Patent
Kim

(10) Patent No.: US 9,202,419 B2
(45) Date of Patent: Dec. 1, 2015

(54) LIQUID CRYSTAL DISPLAY AND METHOD OF DRIVING THE SAME

(75) Inventor: Jonghoon Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 392 days.

(21) Appl. No.: 12/777,701

(22) Filed: May 11, 2010

(65) Prior Publication Data

US 2011/0141002 A1 Jun. 16, 2011

(30) Foreign Application Priority Data

Dec. 15, 2009 (KR) ..... 10-2009-0124996

(51) Int. Cl.
*G09G 3/34* (2006.01)
*G09G 3/32* (2006.01)

(52) U.S. Cl.
CPC ..... *G09G 3/342* (2013.01); *G09G 3/3406* (2013.01); *G09G 3/3426* (2013.01); *G09G 2310/024* (2013.01); *G09G 2310/0237* (2013.01); *G09G 2320/0261* (2013.01); *G09G 2320/0271* (2013.01); *G09G 2320/064* (2013.01); *G09G 2320/0646* (2013.01); *G09G 2360/16* (2013.01)

(58) Field of Classification Search
CPC ... G09G 3/3406; G09G 3/342; G09G 3/3426; G09G 2360/16; G09G 2320/0646; G09G 2320/064; G09G 2310/0237; G09G 2310/024; G09G 2310/0221
USPC ..... 345/50, 87–90, 102, 207, 100, 690
See application file for complete search history.

(56) References Cited

U.S. PATENT DOCUMENTS

| | | | | |
|---|---|---|---|---|
| 7,138,974 | B2 * | 11/2006 | Hirakata et al. | 345/98 |
| 8,068,087 | B2 * | 11/2011 | Feng | 345/102 |
| 8,111,238 | B2 * | 2/2012 | Park et al. | 345/102 |
| 8,896,618 | B2 * | 11/2014 | Kwon et al. | 345/589 |
| 2002/0008694 | A1 * | 1/2002 | Miyachi et al. | 345/204 |
| 2002/0067332 | A1 * | 6/2002 | Hirakata et al. | 345/102 |
| 2004/0051692 | A1 * | 3/2004 | Hirakata et al. | 345/102 |
| 2004/0113906 | A1 * | 6/2004 | Lew et al. | 345/211 |
| 2005/0030263 | A1 * | 2/2005 | Yamazaki | 345/75.1 |
| 2005/0184952 | A1 * | 8/2005 | Konno et al. | 345/102 |
| 2005/0212726 | A1 * | 9/2005 | Namba et al. | 345/63 |
| 2006/0082529 | A1 * | 4/2006 | Oyama | 345/82 |
| 2006/0120082 | A1 * | 6/2006 | Choo et al. | 362/276 |

(Continued)

FOREIGN PATENT DOCUMENTS

| | | | |
|---|---|---|---|
| JP | 2007-127785 | A | 5/2007 |
| KR | 1020060077474 | A | 7/2006 |

OTHER PUBLICATIONS

Chinese Office Action (Application No. 201010248495.1), dated Jun. 20, 2012.

(Continued)

*Primary Examiner* — Michael J Eurice
(74) *Attorney, Agent, or Firm* — Fenwick & West LLP

(57) ABSTRACT

A liquid crystal display includes a liquid crystal display panel, a backlight unit including a plurality of light sources, the backlight unit configured to provide light to the liquid crystal display panel, a light source driving unit configured to drive the light sources of the backlight unit using a backlight control signal, and a backlight controller configured to select a backlight dimming value depending on an input image and vary an off-start time of the backlight control signal based on the backlight dimming value.

16 Claims, 9 Drawing Sheets

(56) References Cited

U.S. PATENT DOCUMENTS

| | | | | |
|---|---|---|---|---|
| 2006/0164379 | A1* | 7/2006 | Oh et al. | 345/102 |
| 2006/0208999 | A1* | 9/2006 | Lee et al. | 345/102 |
| 2007/0001997 | A1* | 1/2007 | Kim et al. | 345/102 |
| 2007/0030697 | A1* | 2/2007 | Kim | 362/618 |
| 2007/0097069 | A1* | 5/2007 | Kurokawa et al. | 345/102 |
| 2007/0115228 | A1* | 5/2007 | Roberts et al. | 345/82 |
| 2007/0126757 | A1* | 6/2007 | Itoh et al. | 345/690 |
| 2007/0152926 | A1* | 7/2007 | Kwon | 345/82 |
| 2008/0111502 | A1* | 5/2008 | Kim et al. | 315/294 |
| 2008/0191998 | A1* | 8/2008 | Kuwabata | 345/102 |
| 2008/0238935 | A1* | 10/2008 | Huang et al. | 345/617 |
| 2008/0284716 | A1* | 11/2008 | Edwards et al. | 345/102 |
| 2008/0284721 | A1* | 11/2008 | Hasegawa | 345/102 |
| 2008/0316167 | A1* | 12/2008 | Kurokawa et al. | 345/102 |
| 2009/0140665 | A1* | 6/2009 | Park | 315/291 |
| 2009/0140975 | A1* | 6/2009 | Nonaka et al. | 345/102 |
| 2009/0174638 | A1* | 7/2009 | Brown Elliott et al. | 345/88 |
| 2009/0184917 | A1* | 7/2009 | Park et al. | 345/102 |
| 2009/0295706 | A1* | 12/2009 | Feng | 345/102 |

OTHER PUBLICATIONS

Office Action dated Apr. 11, 2013 issued by the Korean Intellectual Property Office in Korean Patent Application No. 10-2009-0124996.

* cited by examiner

LIQUID CRYSTAL DISPLAY AND METHOD OF DRIVING THE SAME

This application claims the benefit of Korea Patent Application No. 10-2009-0124996 filed on Dec. 15, 2009, the entire contents of which is incorporated herein by reference.

BACKGROUND OF THE INVENTION

1. Field of the Invention

The present invention relates to a liquid crystal display, and more particularly, to a liquid crystal display and a method of driving the same.

2. Discussion of the Related Art

A range of application for liquid crystal displays has gradually widened because of its excellent characteristics such as light weight, thin profile, and low power consumption. The liquid crystal displays have been used in personal computers such as a notebook PCs, office automation equipments, audio/video equipments, interior/outdoor advertising display devices, and the like. A backlit liquid crystal display occupying most of the liquid crystal displays controls an electric field applied to a liquid crystal layer and modulates light coming from a backlight unit, thereby displaying an image.

When the liquid crystal display displays a motion picture, the observer may perceive a motion blur because of the characteristics of liquid crystals. A scanning backlight driving technology may provide an effect similar to an impulsive drive of a cathode ray tube (CRT) by sequentially turning on and off a plurality of light sources of a backlight unit along a scanning direction of display lines, and thus may solve the motion blur of the liquid crystal display. However, because the light sources of the backlight unit are turned off for predetermined time in each frame period in the scanning backlight driving technology, the display screen becomes dark.

To reduce the problem of the dark display screen resulting from turn-off time (or off-duty time) of the backlight unit in the scanning backlight driving technology, the turn-off time of the backlight unit can be varied by varying a backlight dimming value depending on a brightness of the display screen, thereby allowing the changes in the luminance of the display screen depending on changes in the turn-off time of the backlight unit to be compensated for data modulation. However, in the liquid crystal display having a wide range of variation of the turn-off time of the backlight unit, when the turn-off time of the backlight unit varies, the display quality of the liquid crystal display degrades because the motion picture response time (MPRT) increases.

SUMMARY OF THE INVENTION

Accordingly, the present invention is directed to a liquid crystal display and method for driving the same that substantially obviates one or more problems due to limitations and disadvantages of the related art.

An object of the present invention is to provide a liquid crystal display and a method of driving the same capable of solving the problem of long motion picture response time (MPRT) generated when turn-off time of a backlight unit varies.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display includes a liquid crystal display panel, a backlight unit including a plurality of light sources, the backlight unit configured to provide light to the liquid crystal display panel, a light source driving unit configured to drive the light sources of the backlight unit using a backlight control signal, and a backlight controller configured to select a backlight dimming value depending on an input image and vary an off-start time of the backlight control signal based on the backlight dimming value.

In another aspect, the liquid crystal display includes a liquid crystal display panel, a backlight unit including a plurality of light sources, the backlight unit configured to provide light to the liquid crystal display panel, a light source driving unit configured to drive the light sources of the backlight unit using a backlight control signal, and a backlight controller configured to detect a change in a backlight dimming value of consecutive input images and vary an off-start time of the backlight control signal based on the detected change in the backlight dimming value.

In another aspect, the backlight controller includes an input image analysis unit configured to select a frame representative value of an input image corresponding to one frame period, a dimming calculation unit configured to select a backlight dimming value based on the frame representative value, a scanning time determination unit configured to generate an off-start time data based on the backlight dimming value and vary the off-start time data depending on changes in the backlight dimming value, and a dimming controller configured to select a duty ratio of a backlight control signal based on the backlight dimming value and control a falling edge time of the backlight control signal.

In another aspect, the method of driving a liquid crystal display includes providing light to the liquid crystal display panel, driving light sources of a backlight unit using a backlight control signal, selecting a backlight dimming value depending on an input image, and varying an off-start time of the backlight control signal based on the backlight dimming value using a backlight controller.

In another aspect, the method of driving a liquid crystal display includes providing light to the liquid crystal display panel, driving light sources of a backlight unit using a backlight control signal, selecting a backlight dimming value depending on an input image, and varying an off-start time of the backlight control signal based on a change in the backlight dimming value of consecutive input images using a backlight controller.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the preferred embodiments of the present invention, examples of which are illustrated in the accompanying drawings.

Figure 1:
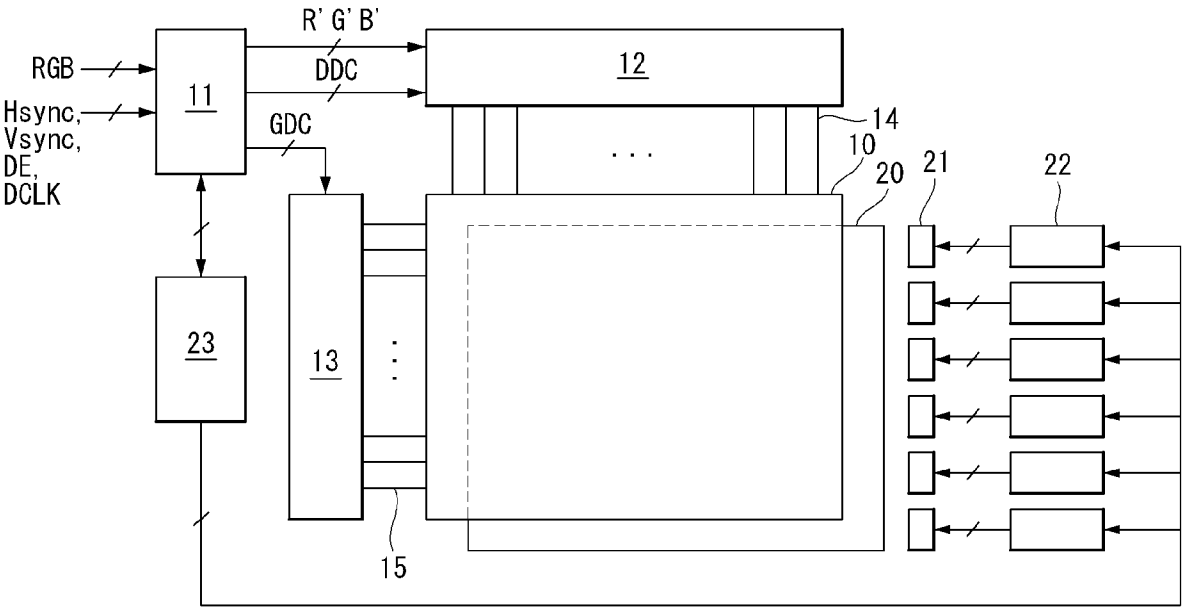
FIG. 1 is a block diagram showing a liquid crystal display according to an exemplary embodiment of the invention.
Figure 2:
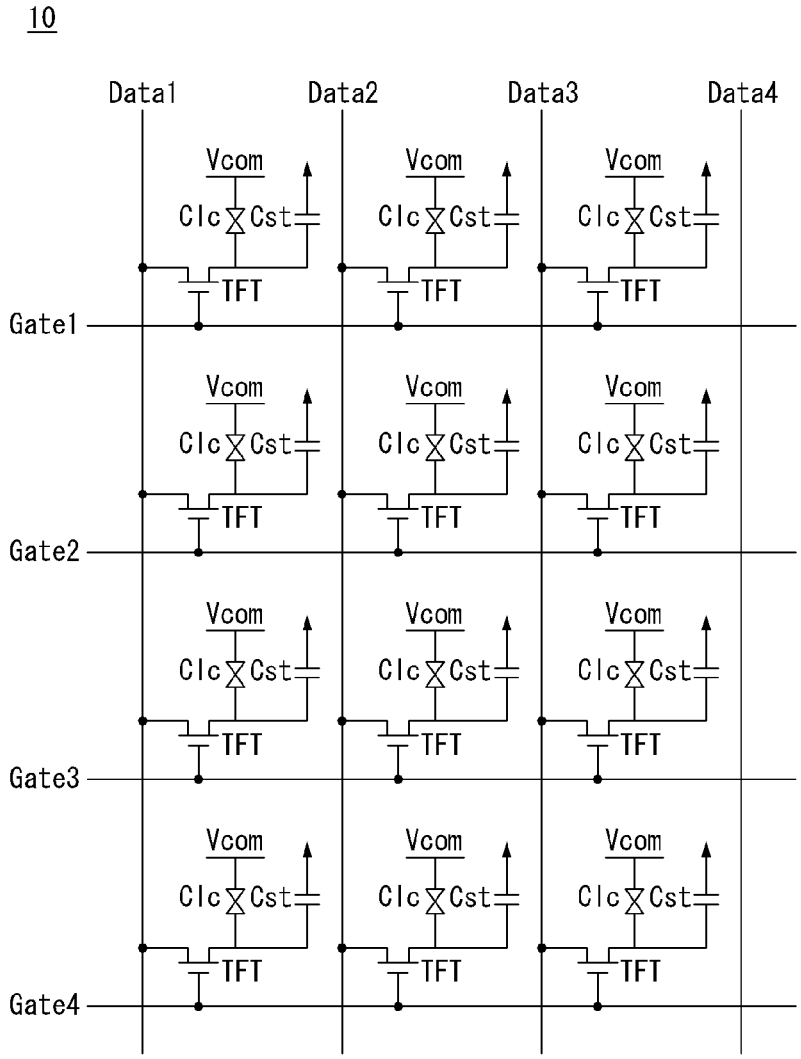
FIG. 2 is an equivalent circuit diagram showing a portion of a pixel array of a liquid crystal display panel shown in FIG. 1.

As shown in FIGS. 1 and 2, a liquid crystal display according to an exemplary embodiment of the invention includes a liquid crystal display panel 10, a source driving unit 12 for driving data lines 14 of the liquid crystal display panel 10, a gate driving unit 13 for driving gate lines 15 of the liquid crystal display panel 10, a timing controller 11 for controlling the source driving unit 12 and the gate driving unit 13, a backlight unit proving light to the liquid crystal display panel 10, and a backlight controller 23 for controlling a sequential drive of a plurality of light sources 21 of the backlight unit, and a light source driving unit 22.

The liquid crystal display panel 10 includes an upper glass substrate, a lower glass substrate, and a liquid crystal layer between the upper and lower glass substrates. The plurality of data lines 14 and the plurality of gate lines 15 cross one another on the lower glass substrate of the liquid crystal display panel 10. A plurality of liquid crystal cells Clc are arranged on the liquid crystal display panel 10 in a matrix form in accordance with a crossing structure of the data lines 14 and the gate lines 15.

As shown in FIG. 2, a pixel array is formed on the lower glass substrate of the liquid crystal display panel 10. The pixel array includes the data lines 14, the gate lines 15, thin film transistors TFT, pixel electrodes of the liquid crystal cells Clc connected to the thin film transistors TFT, storage capacitors Cst, and the like.

A black matrix, a color filter, and a common electrode are formed on the upper glass substrate of the liquid crystal display panel 10. In a vertical electric field driving manner, such as a twisted nematic (TN) mode and a vertical alignment (VA) mode, the common electrode is formed on the upper glass substrate. In a horizontal electric field driving manner, such as an in-plane switching (IPS) mode and a fringe field switching (FFS) mode, the common electrode and the pixel electrode are formed on the lower glass substrate. Polarizing plates are respectively attached to the upper and lower glass substrates of the liquid crystal display panel 10. Alignment layers for setting a pre-tilt angle of liquid crystals are respectively formed on the inner surfaces contacting the liquid crystals in the upper and lower glass substrates.

The source driving unit 12 includes a plurality of source driver integrated circuits (ICs). The source driving unit 12 latches the digital video data R'G'B' under the control of the timing controller 11. The source driving unit 12 converts the digital video data R'G'B' into positive and negative analog data voltages using positive and negative gamma compensation voltages to supply the positive/negative analog data voltages to the data lines 14.

The gate driving unit 13 includes a plurality of gate driver ICs. The gate driving unit 13 includes a shift register, a level shifter for converting an output signal of the shift register into a swing width suitable for a TFT drive of the liquid crystal cells, an output buffer, and the like. The plurality of gate driver ICs of the gate driving unit 13 sequentially output a gate pulse (or a scan pulse) having a pulse width of about one horizontal period to supply the gate pulse to the gate lines 15.

The timing controller 11 receives data RGB of an input image and timing signals Vsync, Hsync, DE, and DCLK from an external system board. The timing signals Vsync, Hsync, DE, and DCLK include a vertical sync signal Vsync, a horizontal sync signal Hsync, a data enable signal DE, and a dot clock DCLK. The timing controller 11 generates a source timing control signal DDC and a gate timing control signal GDC for controlling operation timings of the source driving unit 12 and the gate driving unit 13, respectively, based on the timing signals Vsync, Hsync, DE, and DCLK received from the system board. The timing controller 11 supplies the data RGB of the input image to the backlight controller 23 and receives the modulated data R'G'B' modulated by the backlight controller 23 to supply the modulated data R'G'B' to the source driving unit 12. The timing controller 11 inserts an interpolation frame between frames of a signal of the input image input at a frame frequency of 60 Hz and multiplies the frequency of the source timing control signal DDC by the frequency of the gate timing control signal GDC. Hence, the timing controller 11 can control operations of the source driving unit 12 and the gate driving unit 13 at a frame frequency of (60×N) Hz, where N is a positive integer equal to or greater than 2.

The backlight unit may be one of an edge type backlight unit and a direct type backlight unit. In the edge type backlight unit, the plurality of light sources 21 are positioned the sides of the light guide plate 20, and a plurality of optical sheets are positioned between the liquid crystal display panel 10 and the light guide plate 20. In the direct type backlight unit, a plurality of optical sheets and a diffusion plate are stacked under the liquid crystal display panel 10 and the plurality of light sources 21 are positioned under the diffusion plate. The light sources 21 may be at least one of a cold cathode fluorescent lamp (CCFL), an external electrode fluorescent lamp (EEFL), and a light emitting diode (LED). The optical sheets include at least one prism sheet and at least one diffusion sheet to diffuse light from the light guide plate 20 or the diffusion plate and to refract the travel path of light traveling substantially perpendicular to a light incident surface of the liquid crystal display panel 10. The optical sheets may include a dual brightness enhancement film (DBEF).

The backlight controller 23 controls the light sources 21 using a backlight control signal, e.g., a pulse width modulation (PWM) signal, pulse amplitude modulation (PAM) signal, pulse frequency modulation (PFM) signal, so that the light sources 21 are sequentially driven along a data scanning direction of the liquid crystal display panel 10 under the control of the timing controller 11. The backlight controller 23 analyzes the input image data RGB to select a backlight dimming value and adjusts the duty ratio of the PWM signal depending on the backlight dimming value thereby controlling the light source driving unit 22.

When the turn-off time of the light sources 21 varies depending on changes in the backlight dimming value, the backlight controller 23 controls the turn-off start time point of the light sources 21 by varying the off-start time of the PWM signal. For example, as the backlight dimming value decreases, the backlight controller 23 may allow the turn-off start time point of the light sources 21 to be advanced.

Figure 3:
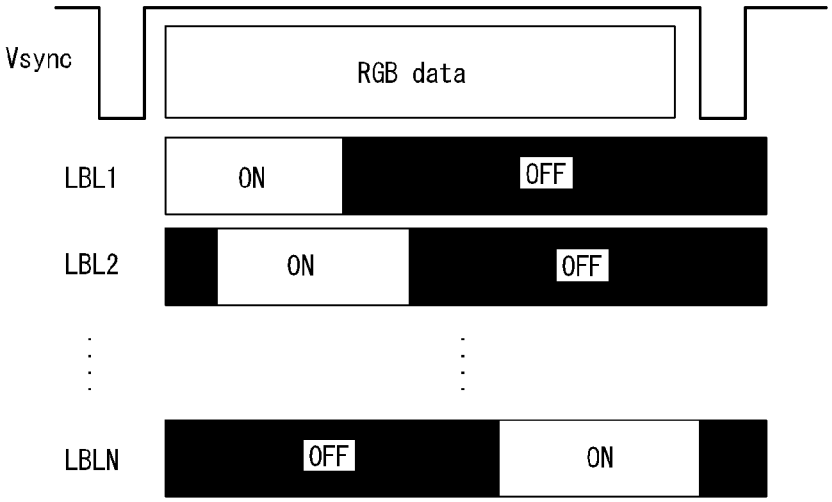
FIG. 3 is an exemplary timing diagram showing a scanning backlight drive according to the exemplary embodiment of the invention.

As shown in FIG. 3, the light source driving unit 22, sequentially turns on and off the light sources 21 in response to the PWM signal or digital data type backlight dimming data and off-start time data indicating the turn-off start time point of the light sources 21 that are received from the backlight controller 23. The light sources 21 are turned on and off depending on a turn-on percentage and a turn-off percentage determined by the PWM signal or the backlight dimming data. In addition, the light sources 21 are sequentially turned on in synchronization with the data scanning operation of the liquid crystal display panel 10. In FIG. 3, LBL1 to LBLN denote a plurality of blocks divided from a light emitting surface of the backlight unit. Each of the blocks LBL1 to LBLN is turned on and off by the light sources 21 wherein the turn-on percentage and the turn-off percentage thereof are determined by the PWM signal. In FIG. 3, "ON" denotes turn-on time of the blocks LBL1 to LBLN during one frame period, and "OFF" denotes turn-off time of the blocks LBL1 to LBLN during one frame period. The turn-on time and the turn-off time of the light sources 21 are determined by the PWM signal received from the backlight controller 23. The turn-on time "ON" of the light sources 21 increases as a duty ratio of the PWM signal increases, and shortens as the duty ratio of the PWM signal decreases. On the other hand, the turn-off time "OFF" of the light sources 21 increases as the duty ratio of the PWM signal decreases, and shortens as the duty ratio of the PWM signal increases.

Figure 4:
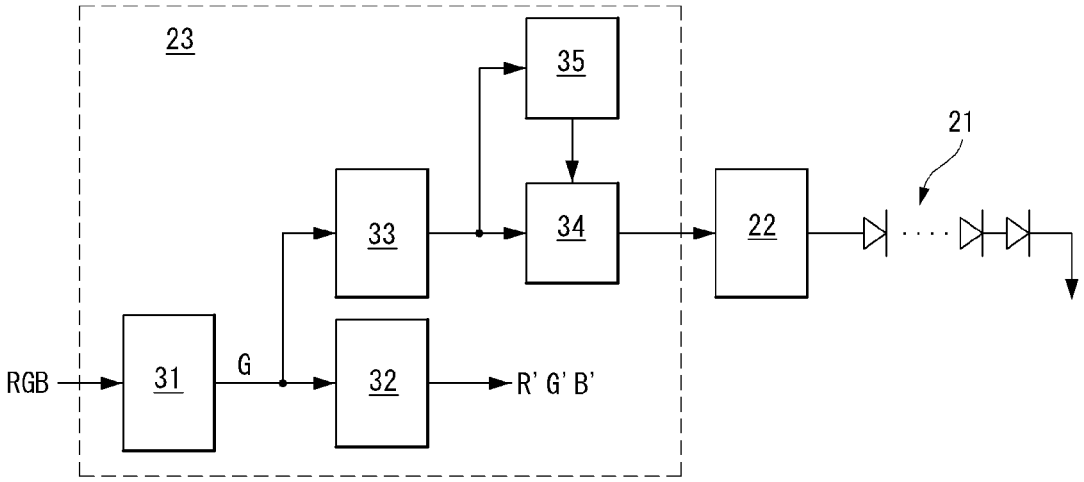
FIG. 4 is a circuit diagram showing a first exemplary embodiment of a backlight controller shown in FIG. 1.

FIG. 4 is a circuit diagram showing the backlight controller 23, in detail, and the light source driving unit 22. As shown in FIG. 4, the backlight controller 23 includes an input image analysis unit 31, a data modulation unit 32, a dimming calculation unit 33, a dimming controller 34, and a scanning time determination unit 35.

The input image analysis unit 31 calculates a histogram (i.e., a cumulative distribution function) of input image data RGB corresponding to one frame and selects a frame representative value from the histogram. The frame representative value may be calculated using one of a mean value, a mode value (indicating a value that occurs the most frequently in the histogram), and a maximum value of the histogram. The input image analysis unit 31 determines a gain value depending on the frame representative value and supplies the gain value to the data modulation unit 32 and the dimming calculation unit 33. The gain value may decrease as the frame representative value increases, and may increase as the frame representative value decreases. For example, when the gain value and the frame representative value are respectively denoted by "G" and "FR", the gain value G may be calculated as G=255/FR.

The data modulation unit 32 receives the gain value from the input image analysis unit 31 and modulates the input image data RGB based on the gain value to generate the modulation data R'G'B' to be input to the source driving unit 12. More specifically, the data modulation unit 32 compares the current gain value received from the input image analysis unit 31 with the previously calculated gain value and corrects the current gain value when there is a difference between the current gain value and the previously calculated gain value. Then, the data modulation unit 32 multiplies the corrected current gain value by the input image data RGB to calculate the modulation data R'G'B'. A data modulation operation performed by the data modulation unit 32 may be implemented using a look-up table.

The dimming calculation unit 33 selects a backlight dimming value DIM based on the gain value received from the input image analysis unit 31. The dimming calculation unit 33 may select the backlight dimming value DIM using a method for calculating the backlight dimming value DIM through a backlight dimming curve set by a relationship between the gain value and the backlight dimming value DIM. The backlight dimming value DIM increases as the gain value increases. The backlight dimming curve may be implemented using a look-up table.

The dimming controller 34 selects a duty ratio of the PWM signal based on the digital data type backlight dimming value DIM received from the dimming calculation unit 33. As the backlight dimming value DIM increases, the duty ratio of the PWM signal and the on-duty time (or high-logic hold time) of the PWM signal increase. On the other hand, the off-duty time of the PWM signal shortens as the backlight dimming value DIM increases, and vice versa.

The dimming controller 34 advances or retards the phase of the PWM signal based on the off-start time data received from the scanning time determination unit 35. The dimming controller 34 inverts the PWM signal based on the off-start time data variation, which results from changes in the backlight dimming value DIM. For example, as the off-start time data value decreases, the dimming controller 34 advances the phase of the PWM signal to advance the off-start time of the PWM signal. On the other hand, as the off-start time data value increases, the dimming controller 34 retards the phase of the PWM signal to delay the off-start time of the PWM signal. In the exemplary embodiment, the off-start time of the PWM signal indicates a falling edge time where the PWM signal changes from a high logic level to a low logic level.

The scanning time determination unit 35 outputs the off-start time data based on the backlight dimming value DIM received from the dimming calculation unit 33. The off-start time data is an optimized value of the motion picture response time (MPRT) in each of the backlight dimming values DIM obtained through an experiment of motion picture response time required to raise the luminance of data to a target luminance of next data. The off-start time data is set to be a different value for each of the backlight dimming values DIM. Thus, when the backlight dimming value DIM changes, the off-start time data varies. For example, the off-start time data may be set to decrease as the backlight dimming value DIM decreases, and may be set to increase as the backlight dimming value DIM increases.

Alternatively, the scanning time determination unit 35 may include a memory (not shown) and a comparator (not shown) that is configured to detect the change in the backlight dimming value of consecutive input images. In this case, the scanning time determination unit 35 varies the off-start time of the backlight control signal based on the detected change in the backlight dimming value.

The light source driving unit 22 turns on and off the light sources 21 based on the duty ratio of the PWM signal. The light sources 21 are turned on during a high-logic level period of the PWM signal and are turned off during a low-logic level period of the PWM signal. As described above, the off-start time when the light sources 21 start to be turned off is the optimized value of motion picture response time and is set to be a different value for each of the backlight dimming values DIM.

In another exemplary embodiment of the configuration of the backlight controller 23, the light source driving unit 22 may receive digital data type duty ratio information to generate a PWM signal. More specifically, the dimming controller 34 selects a duty ratio of the PWM signal based on the digital data type backlight dimming value DIM received from the dimming calculation unit 33 and supplies the digital data type duty ratio information to the light source driving unit 22. The dimming controller 34 distinguishes the off-start time data received from the scanning time determination unit 35 from the duty ratio data of the PWM signal to supply the duty ratio data of the PWM signal to the light source driving unit 22. The dimming controller 34 advances or retards the phase of the PWM signal depending on the off-start time data received from the scanning time determination unit 35. A micro control unit (MCU) of the light source driving unit 22 decodes the duty ratio information of the PWM signal and the off-start time data to generate the PWM signal for driving the light sources 21. The duty ratio of the PWM signal is determined based on the duty ratio data of the PWM signal. The falling edge time of the PWM signal is determined based on the off-start time data.

Figure 5:
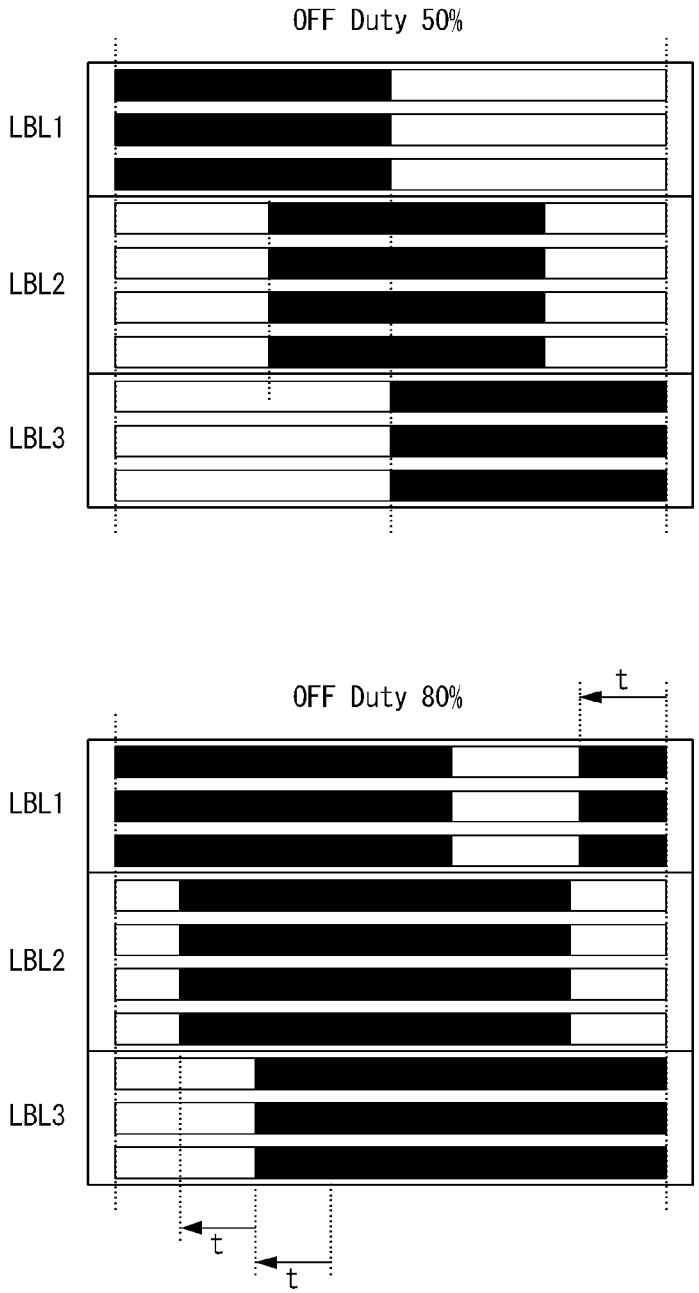
FIG. 5 illustrates examples of off-start times of light sources depending on changes in an off-duty ratio of the backlight unit.

FIG. 5 illustrates examples of off-start time of light sources depending on changes in an off-duty ratio of a backlight unit. As shown in FIG. 5, the backlight controller 23 calculates the backlight dimming value DIM based on the input image data and calculates the duty ratio of the PWM signal based on the calculated backlight dimming value DIM.

More specifically, the backlight controller 23 can be configured such that the off-start time obtained when an off-duty ratio of the PWM signal is 80% (i.e., when the on-duty ratio of the PWM signal is 20%) is earlier than the off-start time obtained when an off-duty ratio of the PWM signal is 50% (i.e., when the percentage occupying a low-logic level period in one cycle of the PWM signal is 50%) by about 800 μs.

FIG. 5 illustrates examples of the off-start time of the backlight unit 23. Other variations may be used for the backlight unit 23. The off-start time when the light sources 21 begin to be turned off is determined based on off-start time of the PWM signal, and the off-start time of the PWM signal is adjusted based on the off-start time data of the PWM signal. Each off-start time of the PWM signal and each off-start time of the light sources 21 may be set to be a different value in each of the backlight dimming values DIM, so that the motion picture response time is optimized in all of the backlight dimming values DIM.

Figure 6:
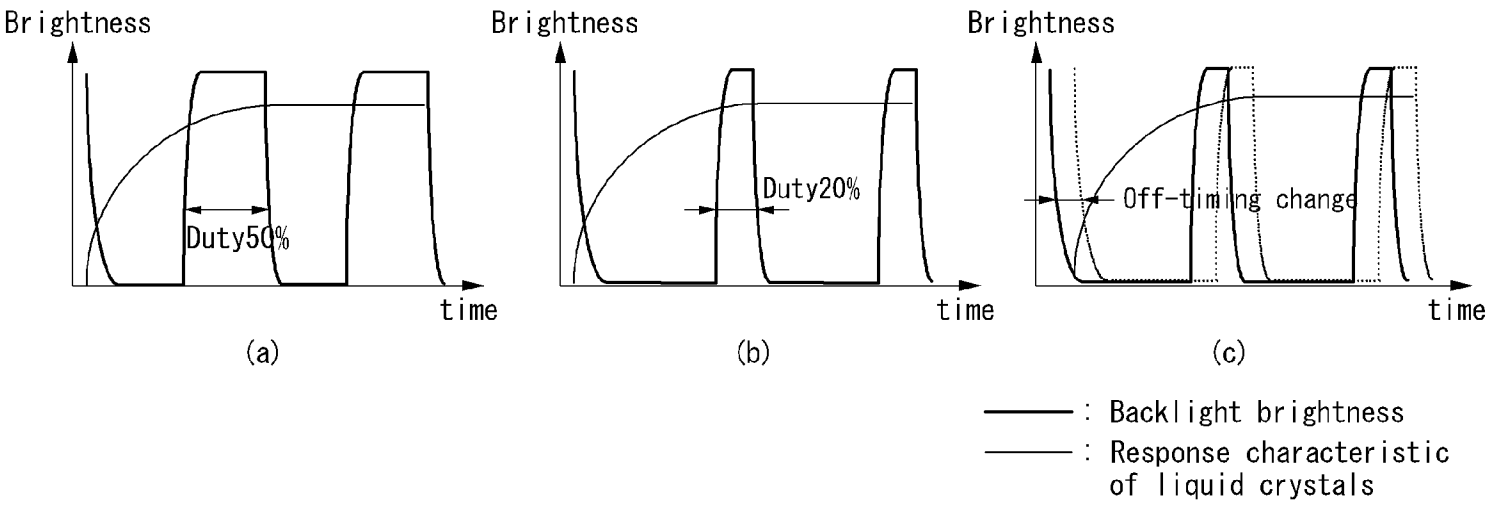
FIGS. 6 to 8 illustrate experimental results of the exemplary embodiment of the invention.
Figure 7:
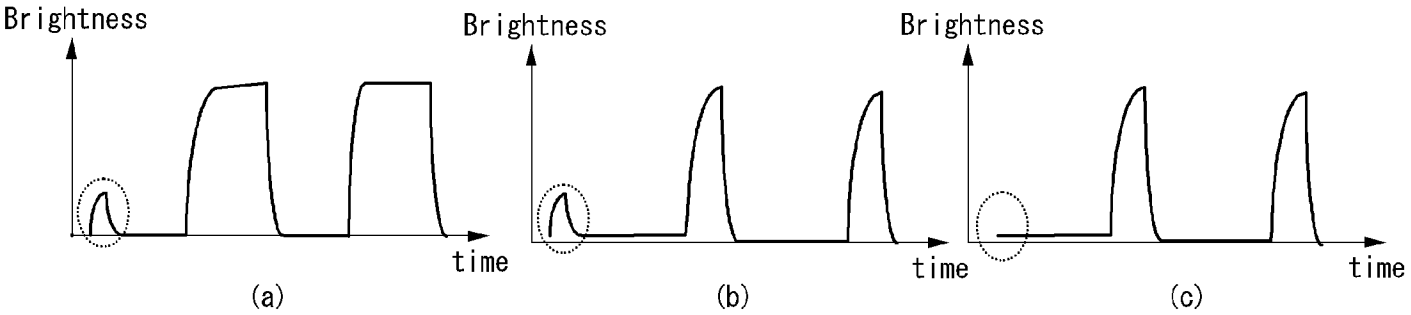
Figure 8:
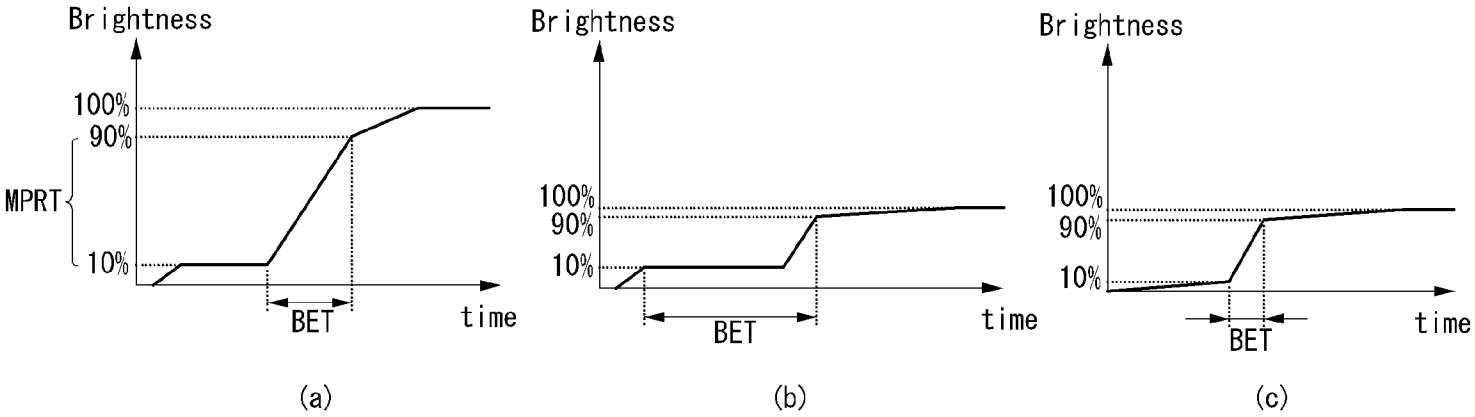

FIGS. 6 to 8 illustrate experimental results of an embodiment of the invention. FIG. 6(*a*) illustrates a response characteristic of the liquid crystals and changes in the backlight brightness when a duty ratio of the backlight unit, i.e., a duty ratio of the PWM signal determining turn-on/off operations of the light sources 21, is 50%. FIG. 6(*b*) illustrates a response characteristic of the liquid crystals and changes in the backlight brightness when the duty ratio of the PWM signal is 20% (i.e., when the off-duty ratio of the PWM signal is 80%). FIG. 6(*c*) illustrates a response characteristic of the liquid crystals and changes in the backlight brightness when the off-start time of the PWM signal at a duty ratio of the PWM signal of 20% (i.e., at an off-duty ratio of the PWM signal of 80%) is advanced by about 800 μs. FIGS. 7(*a*) to 7(*c*) illustrate results obtained by multiplying the response characteristic curves of the liquid crystals with backlight brightness characteristic curves in FIGS. 6(*a*) to 6(*c*), respectively. FIGS. 8(*a*) to 8(*c*) illustrate motion picture response time characteristics obtained by integrating the results obtained in FIGS. 7(*a*) to 7(*c*), respectively, with respect to time.

When the duty ratio of the PWM signal is as low as 20%, as shown in FIG. 6(*b*), synchronization between the response characteristic of the liquid crystals and the PWM signal is not optimized. Therefore, a considerable amount of light leaks in an unwanted portion as indicated by a circle in FIG. 7(*b*). As a result, as shown in FIG. 8(*b*), the blurred edge time (BET) increases, and thus the motion picture response time increases. The motion picture response time is determined by time (i.e., BET) required to reach a luminance of light transmitted by the liquid crystal display panel 10 from 10% to 90% of a target luminance.

On the other hand, even when the duty ratio of the PWM signal is as low as 20% as shown in FIG. 6(*c*), synchronization between the response characteristic of the liquid crystals and the PWM signal can be optimized by advancing the off-start time of the PWM signal. Therefore, light leakage does not occur in an unwanted portion as indicated by a circle in FIG. 7(*c*). As a result, as shown in FIG. 8(*c*), the blurred edge time decreases, and thus the motion picture response time decreases.

The exemplary embodiment of the invention controls based on the experimental results of FIGS. 6 to 8. Accordingly the turn-off start time point of the light sources of the backlight unit when the backlight dimming value is high (for example, when the duty ratio of the PWM signal is 50% as shown in FIGS. 5 and 6) is different from the turn-off start time point of the light sources of the backlight unit when the backlight dimming value is low (for example, when the duty ratio of the PWM signal is 20% as shown in FIGS. 5 and 6).

Figure 9:
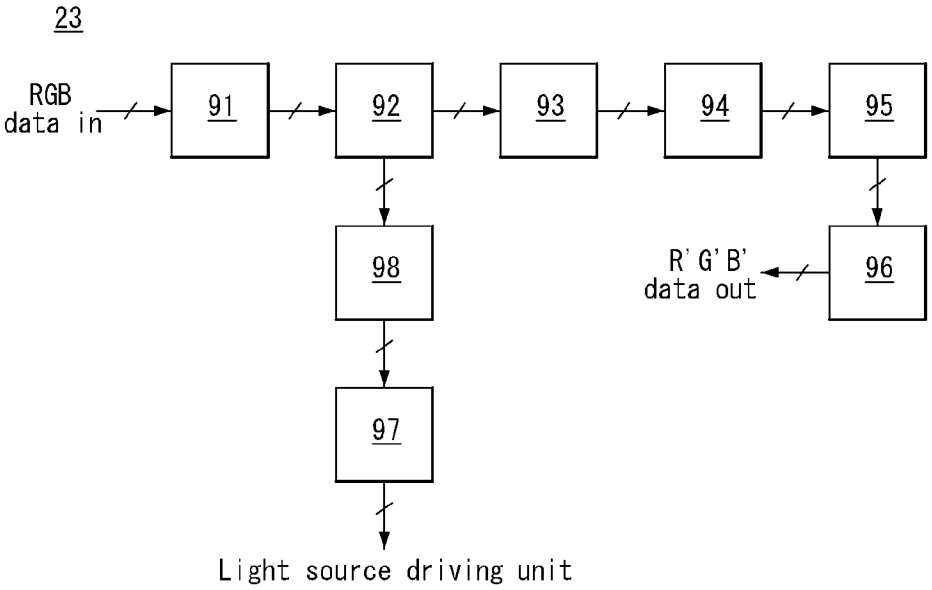
FIG. 9 is a block diagram showing a second exemplary embodiment of a backlight controller shown in FIG. 1.

The backlight controller 23 may be implemented as a local dimming backlight controller. FIG. 9 is a block diagram showing the backlight controller 23, in detail, for local dimming. As shown in FIG. 9, the backlight controller 23 includes a representative value calculation unit 91, a local dimming value selection unit 92, a block selection unit 93, a light amount analysis unit 94, a gain calculation unit 95, a data compensation unit 96, a scanning time determination unit 98, and a light source controller 97.

Figure 10:
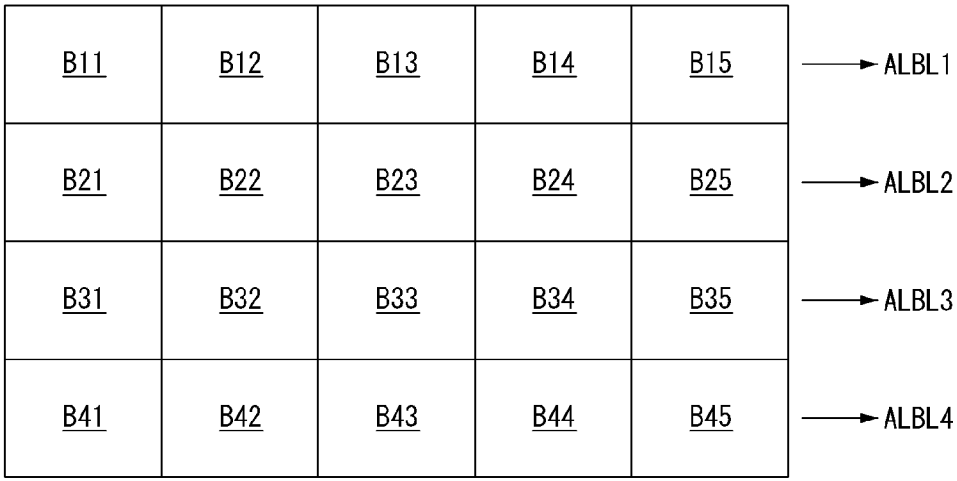
FIG. 10 illustrates an example of dividing a display screen of a liquid crystal display panel and a light emitting surface of a backlight unit into a plurality of blocks for local dimming.

As shown in FIG. 10, the display screen of the liquid crystal display panel 10 and the light emitting surface of the backlight unit can be divided into a plurality of blocks, for example, B11 to B45 in row and column directions so as to perform their local dimming. The representative value calculation unit 91 divides the data RGB of the input image in each of the blocks B11 to B45 to select a representative value for each of the blocks B11 to B45.

The local dimming value selection unit 92 maps the representative value of each of the blocks B11 to B45 to a previously set dimming curve to select a dimming value BLdim for each of the blocks B11 to B45. Further, the local dimming value selection unit 92 calculates an average dimming value ALBL1 of the dimming values BLdim of the blocks B11 to B15 positioned parallel to one another on the same row. The local dimming value selection unit 92 calculates average dimming values ALBL2 to ALBL4 in the same manner as the average dimming value ALBL1. The local dimming value selection unit 92 outputs the dimming values BLdim of the blocks B11 to B45 to the block selection unit 93 and outputs the dimming values BLdim of the blocks B11 to B45 and the average dimming values ALBL1 to ALBL4 to the scanning time determination unit 98.

The block selection unit 93 selects an analysis area of 5×5 size (or 7×7 size) using the dimming values BLdim of the blocks B11 to B45 received from the local dimming value selection unit 92. The light amount analysis unit 94 calculates a total amount of light in each of pixels using dimming values of the selected analysis area.

The gain calculation unit 95 calculates a gain value in each of the pixels. The gain value is calculated by a ratio of an amount of light of a pixel in non-local dimming (i.e., when all of the light sources of the backlight unit are turned on in a full-white pattern or at a maximum brightness) to an amount of light of a pixel calculated through light profile in local dimming. In other words, the gain value G may be calculated to be G=Knormal/Klocal. In the above equation, Knormal is a constant indicating an amount of light in the non-local dimming (i.e., when the light emitting surface of the backlight unit is turned on in the full-white pattern), and Klocal is a variable indicating the amount of light of a predetermined pixel depending on the dimming values BLdim of the blocks B11 to B45 when local dimming is performed. The data compensation unit 96 compensates the pixel data by multiplying the gain value with the original pixel data thereby modulating data.

The scanning time determination unit 98 transfers the dimming values BLdim of the blocks B11 to B45 to the light source controller 97 and selects the off-start time data indicating off-start time of the PWM signal, in which the MPRT is optimized based on the average dimming values ALBL1 to ALBL4, to supply the off-start time data to the light source controller 97. The off-start time data is set to be a different value in each of the average dimming values ALBL1 to ALBL4, so that the MPRT can be optimized in all of the average dimming values ALBL1 to ALBL4. Thus, the scanning time determination unit 98 varies the off-start time data of the PWM signal every time the average dimming values ALBL1 to ALBL4 changes.

Alternatively, the scanning time determination unit 98 may include a memory (not shown) and a comparator (not shown) that is configured to detect the change in the backlight dimming value of consecutive input images. In this case, the scanning time determination unit 98 varies the off-start time of the backlight control signal based on the detected change in the backlight dimming value.

The light source controller 97 generates the PWM signal or the digital data type duty ratio based on the dimming values BLdim of the blocks B11 to B45 received from the local dimming value selection unit 92. The light source driving unit 22 supplies the PWM signal generated by the light source controller 97 to the light source driving unit 22 of each of the blocks B11 to B45 through a serial peripheral interface (SPI). In another exemplary embodiment of the light source controller 97, the light source controller 97 decodes the digital data type duty ratio and the off-start time data to generate the PWM signal and supplies the generated PWM signal to the light source driving unit 22 of each of the blocks B11 to B45 through the SPI. The light source controller 97 varies the off-start time of the PWM signal based on the off-start time data received from the scanning time determination unit 35.

As described above, the exemplary embodiment of the invention sets the off-start time of the PWM signal, in which the motion picture response time is optimized in each backlight dimming value, and thus can prevent an increase in the motion picture response time even if the backlight dimming value changes.

It will be apparent to those skilled in the art that various modifications and variations can be made in the liquid crystal display and method of driving the same of the present invention without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel;

a backlight unit comprising a plurality of light sources arranged along a first direction, each of the plurality of light sources extending in a second direction perpendicular to the first direction to provide light to a section of the liquid crystal display panel;

a light source driving unit configured to receive backlight control signals, each of the backlight control signals indicating on-times and off-times of a corresponding light source, the light source driving unit further configured to turn on or off each of the plurality of light sources of the backlight unit according to a corresponding backlight control signal; and a backlight controller configured to:

select backlight dimming values for blocks of an input image, the blocks arranged in the first direction and the second direction;

calculate average dimming values based on the selected backlight dimming values, each average dimming value calculated for a subset of blocks of the input image to be displayed on a section of the liquid crystal display panel that is provided with light by each of the light sources; and generate backlight control signals to operate the plurality of light sources, a duty ratio of each of the backlight control signals corresponding to each of the light sources increased responsive to increasing of each average dimming value of the subset of blocks of the input image and decreased responsive to decreasing of each average dimming value, a phase of each of the backlight control signals delayed responsive to increasing of each average dimming value, the phase advanced responsive to decreasing of each average dimming value.

2. The liquid crystal display of claim 1, wherein each of the backlight control signals comprises at least one of a pulse width modulation (PWM) signal, pulse amplitude modulation (PAM) signal, and pulse frequency modulation (PFM) signal.

3. The liquid crystal display of claim 1, wherein the backlight controller is further configured to progressively offset the backlight control signals to match scanning timing of corresponding light sources.

4. The liquid crystal display of claim 1, wherein the backlight controller is further configured to calculate a gain value in each of the pixels and compensate a pixel data by multiplying the gain value with an original pixel data.

5. The liquid crystal display of claim 1, wherein at least one of the backlight control signal indicate turning off of at least one of the light source for a single time in a frame period.

6. The liquid crystal display of claim 1, wherein the first direction is horizontal direction and the second direction is a vertical direction.

7. The liquid crystal display of claim 1, wherein a blurred edge time (BET) is decreased by advancing the phase when the duty ratio is decreased.

8. The liquid crystal display of claim 1, wherein each of the backlight control signals is a digital signal.

9. The liquid crystal display of claim 8, wherein the light source driving unit is configured to receive the backlight control signals and generate pulse width modulation (PWM) signals based on the backlight control signals.

10. A method of driving a liquid crystal display, the method compromising:

receiving an input image;

selecting backlight dimming values for blocks of the input image, the blocks arranged in a first direction and a second direction;

calculating average dimming values based on the selected backlight dimming values, each average dimming value calculated for a subset of blocks of the input image to be displayed on a section of a liquid crystal panel that is provided with light by each of the light sources;

generating backlight control signals, a duty ratio of each of the backlight control signals corresponding to each of the light sources increased responsive to increasing of each average dimming value of the subset of blocks of the input image and decreased responsive to decreasing of each average dimming value, a phase of each of the backlight control signals delayed responsive to increasing of each average dimming value, the phase advanced responsive to decreasing of each average dimming value; and turning on or turning off each of a plurality of light sources arranged behind a liquid crystal display unit along the first direction at times as indicated by a corresponding backlight control signal, each of the plurality of light sources extending in the second direction.

11. The method of claim 10, wherein the backlight control signal comprises at least one of a pulse width modulation (PWM) signal, pulse amplitude modulation (PAM) signal, and pulse frequency modulation (PFM) signal.

12. The method of claim 10, wherein at least one of the backlight control signal indicate turning off of at least one of the light source for a single time in a frame period.

13. The method of claim 10, wherein the first direction is horizontal direction and the second direction is a vertical direction.

14. The method of claim 10, wherein a blurred edge time (BET) is decreased by advancing the phase when the duty ratio is decreased.

15. The method of claim 10, wherein each of the backlight control signals is a digital signal.

16. The method of claim 15, further comprising generating pulse width modulation (PWM) signals based on the backlight control signals.

* * * * *